United States Patent [19]

Augros

[11] Patent Number: 4,909,693

[45] Date of Patent: Mar. 20, 1990

[54] METHOD OF JOINING PRINTED SHEETS TO FORM A PAD, IN PARTICULAR FOR MANUFACTURING CALENDARS

[75] Inventor: Jean Augros, Velizy, France

[73] Assignee: Calendriers Jean Lavigne, Boulogne-sur-Seine, France

[21] Appl. No.: 257,094

[22] Filed: Oct. 13, 1988

[30] Foreign Application Priority Data

Oct. 21, 1987 [FR] France ..... 8714557

[51] Int. Cl.[4] ..... B42B 5/00; B42C 9/00

[52] U.S. Cl. ..... 412/8; 281/15.1; 281/21.1; 412/6

[58] Field of Search ..... 281/15.1, 21.1, 51; 156/908; 412/6, 8, 37

[56] References Cited

U.S. PATENT DOCUMENTS 3,560,290 2/1971 Sendor et al. ..... 412/8

FOREIGN PATENT DOCUMENTS 887410 7/1979 Belgium .

0015153 9/1980 European Pat. Off. .

*Primary Examiner*—Paul A. Bell

*Attorney, Agent, or Firm*—Beveridge, DeGrandi & Weilacher

[57] ABSTRACT

In a method of joining printed sheets to form a pad by compressing the top of the stacked sheets between the plates of a printed press the sheets are printed on coated paper having sufficient microporosity to retain on the surface the adhesive agents of the ink employed. The sheets are printed with an ordinary ink which polymerizes naturally in air. A pressure of 100 to 250 daN/cm$^2$ and preferably greater than 150 daN/cm$^2$ is applied between the press plates over an area reserved for gluing. The microporosity of the paper as measured by the offset test on the I.T.G. machine using Lorilleux 3800 ink gives the following optical density results: after 15 seconds: 0.30 to 0.80; after 60 seconds: 0.10 to 0.60. A plurality of stacked pads separated by heating or heated separators may be pressed simultaneously. The press plates may carry complementary waffle or groove patterning in the area reserved for gluing. The press plates may be covered with a non-stick film which may be a silicone-based product.

7 Claims, No Drawings

METHOD OF JOINING PRINTED SHEETS TO FORM A PAD, IN PARTICULAR FOR MANUFACTURING CALENDARS

BACKGROUND OF THE INVENTION

1. Field of the Invention

The invention concerns joining printed sheets to form a pad, in particular to manufacture calendars from pre-printed month sheets.

2. Description of the Prior Art

There is known from French Pat. No. 1 604 324 and its patents of addition 2 075 854 and 2 082 540 a method of joining printed sheets without using glue by reactivating resins included in the ink by heating and pressing the sheets. According to these documents, the assembled sheets are stacked between the plates of a heated press under a low pressure of 2 to 4 kg/cm$^2$, as stated in those documents, that is 2 to 4 daN/cm$^2$.

However, the slowness of the method generally makes it impossible to integrate it in-line with the preceding operations (assembly of the printed sheets) or the subsequent operations, unless these operations are slowed down to an exaggerated degree, which is not highly cost-effective.

Also, not all kinds of paper have been suitable for use of this method, in particular porous paper.

Also, because of how they dry, either by evaporation of solvents (helio (photogravure) inks) or by acceleration of the process by infra-red or ultra-violet light, some inks lose the capability of reactivating their adhesive properties and so their suitability for use in this method.

An object of the invention is to eliminate the foregoing disadvantage by providing improved adhesion with a pressing time in the order of one second.

SUMMARY OF THE INVENTION

The invention consists in a method of joining printed sheets to form a pad by compressing the top of the stacked sheets between the plates of a heated press, in which method:

- the sheets are printed on coated paper having sufficient microporosity to retain on the surface the adhesive agents of the ink employed;
- the sheets are printed with an ordinary litho or letterpress ink which polymerizes naturally in air; and
- a pressure of 100 to 250 daN/cm$^2$ is applied between said press plates over an area reserved for gluing.

Other features of the invention will emerge from the following description of one example of its implementation.

The paper used is a matt or gloss coated paper the microporosity of which as measured by the offset test on the I.G.T. machine using Lorilleux 3800 ink gives the following optical density results:

after 15 seconds: 0.30 to 0.80, after 60 seconds: 0.10 to 0.60.

This paper is printed using ordinary litho or letterpress ink which polymerizes naturally in air, that is to say without activation by ultra-violet light.

To assemble the 12 to 14 sheets that a calendar usually comprises, or two calendars each of six sheets, printed on 100 to 140 g/m$^2$ coated paper a pressure of 150 daN/cm$^2$ is used. This pressure may vary according to the size of the area to be heat-bonded, given the variation in the dispersion of heat, and the surface state of the paper, which can be matt, gloss or textured.

This minimum pressure may therefore be considerably exceeded and reach a figure as high as 200 to 250 daN/cm$^2$. However, the risks of the calendar adhering to the press tool make it necessary to use the minimum pressure compatible with the above stated parameters. Naturally these limits may be moved back by coating the press tools with a non-stick film such as a film of silicone.

The production rate may be as high as one pressing operation per second. The output at this speed can be further increased, if desired, by pressing a plurality of superposed calendars, providing that heating or heated separators are placed between them.

Finally, the high pressure employed may be combined in a known way with complementary waffle or groove patterning of the press tools to produce, for example, one or more grooves of substantially trapezoidal profile, which not only significantly increases the adhesion pressure on the flanks of the trapezium, but also increases the stiffness of the top of the calendar obtained.

I claim:

1. Method of joining printed sheets to form a pad by compressing the top of the stacked sheets between the plates of a heated press, in which method:

- the sheets are printed on coated paper having sufficient microporosity to retain on the surface the adhesive agents of the ink employed;
- the sheets are printed with an ordinary ink which polymerizes naturally in air; and
- a pressure of 100 to 250 daN/cm$^2$ is applied between said press plates over an area reserved for gluing.

2. Method according to claim 1, wherein said pressure is 150 daN/cm$^2$ or greater.

3. Method according to claim 1, wherein the microporosity of said paper as measured by the offset test on the I.G.T. machine using Lorilleux 3800 ink gives the following optical density results:

after 15 seconds: 0.30 to 0.80, after 60 seconds: 0.10 to 0.60.

4. Method according to claim 1, wherein a plurality of stacked pads separated by heating or heated separators are pressed simultaneously.

5. Method according to claim 1, wherein said press plates carry complementary waffle or groove patterning in said area reserved for gluing.

6. Method according to claim 1, wherein said press plates are covered with a non-stick film.

7. Method according to claim 6, wherein said film is a silicone-based product.

* * * * *